US012448871B2

(12) United States Patent
Santamaria et al.

(10) Patent No.: US 12,448,871 B2
(45) Date of Patent: Oct. 21, 2025

(54) HIGH SOLIDS CONTENT FLUID TECHNIQUES

(71) Applicant: Schlumberger Technology Corporation, Sugar Land, TX (US)

(72) Inventors: Juan-Carlos Santamaria, Sugar Land, TX (US); Kinga Hendum, Stavanger (NO); Nirupama Vaidya, Sugar Land, TX (US); Elvin Yusifzada, Stavanger (NO); Balkrishna Gadiyar, Sugar Land, TX (US); Christopher Daeffler, Sugar Land, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/761,950

(22) Filed: Jul. 2, 2024

(65) Prior Publication Data

US 2025/0043661 A1 Feb. 6, 2025

Related U.S. Application Data

(60) Provisional application No. 63/511,744, filed on Jul. 3, 2023.

(51) Int. Cl.

| | |
|---|---|
| ***E21B 43/04*** | (2006.01) |
| ***E21B 33/13*** | (2006.01) |
| ***E21B 43/08*** | (2006.01) |

(52) U.S. Cl.

CPC ..... *E21B 43/04* (2013.01); *E21B 33/13* (2013.01); *E21B 43/08* (2013.01)

(58) Field of Classification Search

CPC ..... E21B 43/04; E21B 33/13; E21B 43/08; C09K 8/80

See application file for complete search history.

(56) References Cited

U.S. PATENT DOCUMENTS

| | | | | | |
|---|---|---|---|---|---|
| 2,695,065 | A * | 11/1954 | Baker | E21B 23/065 | 166/187 |
| 2,710,065 | A * | 6/1955 | Hamilton, Jr. | E21B 33/136 | 166/123 |
| 2,909,225 | A * | 10/1959 | Hanes | E21B 27/00 | 166/162 |
| 4,739,829 | A * | 4/1988 | Brunner | E21B 27/02 | 166/63 |
| 5,253,708 | A | 10/1993 | Alexander | | |
| 5,544,705 | A * | 8/1996 | Jones | E21B 27/02 | 166/291 |
| 6,283,213 | B1 * | 9/2001 | Chan | E21B 33/13 | 166/291 |

(Continued)

FOREIGN PATENT DOCUMENTS

EP 2431564 B1 5/2017

OTHER PUBLICATIONS

Search Report and Written Opinion of International Patent Application No. PCT/US2024/036527 dated Oct. 14, 2024, 13 pages.

*Primary Examiner* — Steven A Macdonald
(74) *Attorney, Agent, or Firm* — Rushi C. Sukhavasi

(57) ABSTRACT

A method includes placing, via a bailer, a slurry into a wellbore to deposit a slurry downhole. The slurry includes a solids mixture and a fluid. The method also includes terminating placement of the slurry for a period of time. A viscous pill inhibits settling of the solids mixture, and the slurry displaces the viscous pill in contact with a surface of a screen.

20 Claims, 7 Drawing Sheets

(56) References Cited

U.S. PATENT DOCUMENTS 6,691,778 B2 * 2/2004 Cole ..... E21B 31/005 166/301
7,373,978 B2 * 5/2008 Barry ..... E21B 43/045 166/278
8,113,282 B2 * 2/2012 Picou ..... E21B 43/04 166/278
8,119,574 B2 2/2012 Panga
8,256,513 B2 * 9/2012 Picou ..... E21B 27/02 166/278
8,505,628 B2 8/2013 Panga
8,662,172 B2 3/2014 Panga
8,765,646 B2 7/2014 Panga
8,916,506 B2 12/2014 Panga
8,936,082 B2 * 1/2015 Panga ..... E21B 43/088 166/278
9,133,387 B2 9/2015 Loiseau
11,384,628 B2 * 7/2022 Dorban ..... E21B 34/14
2001/0042622 A1 * 11/2001 Chan ..... E21B 33/13 166/292
2002/0104652 A1 * 8/2002 Cole ..... E21B 31/005 166/301
2007/0068675 A1 * 3/2007 Barry ..... E21B 43/045 166/278
2009/0025932 A1 * 1/2009 Panga ..... C09K 8/80 166/278
2009/0133875 A1 5/2009 Tibbles
2010/0122814 A1 * 5/2010 Picou ..... E21B 43/045 166/278
2010/0126723 A1 5/2010 Ali
2010/0300688 A1 * 12/2010 Panga ..... C09K 8/572 166/280.2
2011/0155371 A1 * 6/2011 Panga ..... C09K 8/805 166/278
2011/0155372 A1 * 6/2011 Panga ..... E21B 43/267 166/278
2012/0000651 A1 * 1/2012 Panga ..... C09K 8/42 166/305.1
2012/0000653 A1 * 1/2012 Panga ..... C09K 8/80 166/280.2
2012/0006544 A1 * 1/2012 Picou ..... E21B 43/04 166/278
2012/0138296 A1 * 6/2012 Panga ..... C09K 8/805 166/280.2
2020/0370393 A1 * 11/2020 Lende ..... E21B 33/138
2021/0372215 A1 * 12/2021 Lende ..... F04B 17/03
2021/0372217 A1 * 12/2021 Lende ..... E21B 33/14
2022/0003068 A1 * 1/2022 Johansen ..... E21B 27/02
2023/0175342 A1 * 6/2023 Burguieres ..... E21B 33/134 166/305.1

* cited by examiner

HIGH SOLIDS CONTENT FLUID TECHNIQUES

CROSS-REFERENCE TO RELATED APPLICATION

This application claims priority to and the benefit of U.S. Provisional Patent Application No. 63/511,744, filed Jul. 3, 2023, entitled "HIGH SOLIDS CONTENT FLUID TECHNIQUES," the disclosure of which application is incorporated herein by reference in its entirety.

BACKGROUND

The present disclosure generally relates to techniques for gravel packing using a high solids content fluid.

This section is intended to introduce the reader to various aspects of art that may be related to various aspects of the present techniques, which are described and/or claimed below. This discussion is believed to be helpful in providing the reader with background information to facilitate a better understanding of the various aspects of the present disclosure. Accordingly, it should be understood that these statements are to be read in this light, and not as an admission of any kind.

A gravel filter is installed by gravel packing in a wellbore between a screen and a formation face and/or a casing to prevent formation sand from flowing into the wellbore and to improve wellbore and near-wellbore conductivity. The conductivity at the wellbore and near-wellbore is important because any damage in these locations significantly increases the pressure drop of fluid flow, thereby reducing the producibility or injectivity of the well. Further, placement techniques for gravel filters, above or below hydraulic fracture pressure of the formation, can be a complex procedure. For instance, the placement techniques may require several stages and the proper functioning of moving parts in a hostile wellbore environment.

SUMMARY

A summary of certain embodiments described herein is set forth below. It should be understood that these aspects are presented merely to provide the reader with a brief summary of these certain embodiments and that these aspects are not intended to limit the scope of this disclosure.

In some aspects, the techniques described herein relate to a method for depositing a solids slurry in a wellbore. The method includes depositing, via a first bailer, a high viscosity fluid at a target location in the wellbore to form a viscous pill. The high viscosity fluid has a plastic viscosity that is greater than a working fluid viscosity of a working fluid in the wellbore. A second bailer deposits a slurry at the viscous pill. The slurry displaces the viscous pill from the target location.

In some aspects, the techniques described herein relate to a gravel filter installation system. The gravel filter installation system includes a screen. A viscous pill is deposited at the screen. The viscous pill has a plastic viscosity greater than 100 mPa·s at 100° C. A solids slurry has a particle size distribution (PSD) such that a packed volume fraction (PVF) exceeds 0.75. The solids slurry includes a solids volume fraction (SVF) less than the PVF of the solids slurry. A bailer is configured to deposit the solids slurry at the viscous pill such that the solids slurry displaces the viscous pill.

In some aspects, the techniques described herein relate to a method, including: placing, via a bailer, a slurry into a wellbore to deposit the slurry downhole, wherein the slurry includes a solids mixture, a fluid, and a stability additive; and terminating placement of the slurry for a period of time, wherein the stability additive inhibits settling of the solids mixture, wherein the slurry displaces a viscous pill in contact with a surface of a screen.

Certain embodiments of the present disclosure include a method that includes placing, via a bailer, a slurry into a wellbore to deposit a slurry downhole. The slurry includes a solids mixture, a fluid, and a stability additive. The method also includes pausing placement of the slurry for a period of time. The stability additive inhibits settling of the solids mixture, and the slurry displaces a viscous pill in contact with a surface of a screen.

Various refinements of the features noted above may be undertaken in relation to various aspects of the present disclosure. Further features may also be incorporated in these various aspects as well. These refinements and additional features may exist individually or in any combination. For instance, various features discussed below in relation to one or more of the illustrated embodiments may be incorporated into any of the above-described aspects of the present disclosure alone or in any combination. The brief summary presented above is intended to familiarize the reader with certain aspects and contexts of embodiments of the present disclosure without limitation to the claimed subject matter.

BRIEF DESCRIPTION OF THE DRAWINGS

Various aspects of this disclosure may be better understood upon reading the following detailed description and upon reference to the drawings, in which:

FIG. 2-1 through FIG. 2-5 illustrate a series of schematic diagrams of a bailer for depositing particulates in an annular placement between an outer surface of a screen and a surface of a wellbore formation, in accordance with embodiments of the present disclosure;

FIG. 3-1 through FIG. 3-5 illustrates a series of schematic diagrams of a bailer for depositing particulates between an outer surface of a screen and a surface of a wellbore formation for an existing completion, in accordance with embodiments of the present disclosure; and FIG. 4 illustrates a tetramodal particle packing model based on the Descartes circle theorem involving mutually tangent circles, in accordance with embodiments of the present disclosure.

FIG. 5 is a representation of a gravel filter installed in a wellbore, in accordance with embodiments of the present disclosure;

FIG. 6-1 and FIG. 6-2 illustrate a series of schematic diagrams of a screen and a viscous pill installed in a wellbore, in accordance with embodiments of the present disclosure;

FIG. 7-1 and FIG. 7-2 illustrate a series of schematic diagrams of a screen and a viscous pill installed in a wellbore, in accordance with embodiments of the present disclosure;

DETAILED DESCRIPTION

Figure 1:
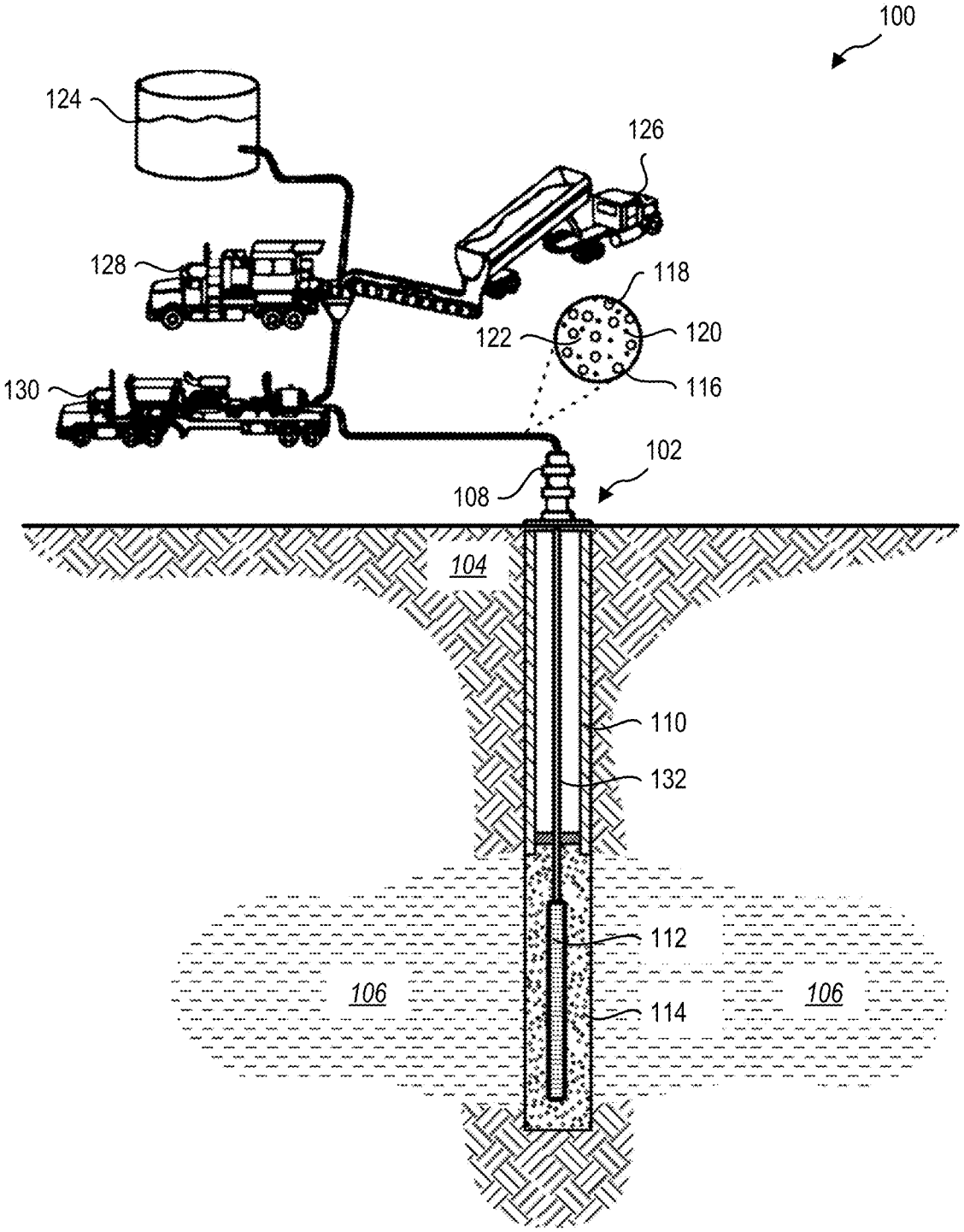
FIG. 1 illustrates a schematic diagram of a system for gravel filter installation.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

As used herein, the terms "connect," "connection," "connected," "in connection with," and "connecting" are used to mean "in direct connection with" or "in connection with via one or more elements"; and the term "set" is used to mean "one element" or "more than one element." Further, the terms "couple," "coupling," "coupled," "coupled together," and "coupled with" are used to mean "directly coupled together" or "coupled together via one or more elements." As used herein, the terms "up" and "down," "uphole" and "downhole", "upper" and "lower," "top" and "bottom," and other like terms indicating relative positions to a given point or element are utilized to more clearly describe some elements. Commonly, these terms relate to a reference point as the surface from which drilling operations are initiated as being the top (e.g., uphole or upper) point and the total depth along the drilling axis being the lowest (e.g., downhole or lower) point, whether the well (e.g., wellbore, borehole) is vertical, horizontal, or slanted relative to the surface.

As used herein, the terms "bimodal" and "multimodal" with respect to particle size or other variable distribution have their standard statistical meanings. In statistics, a bimodal distribution is a continuous probability distribution with two different modes. A mixture is considered to be multimodal if it has two or more modes. A bimodal distribution can arise as a mixture of two different unimodal distributions, i.e., distribution having only one mode. For example, a bimodally distributed particle size can be defined as PSD1 with probability $\alpha$ or PSD2 with probability $(1-\alpha)$, where PSD1 and PSD2 are different unimodal particle sizes and $0<\alpha<1$ is a mixture coefficient. A mixture of two unimodal distributions with differing means is not necessarily bimodal; however, a mixture of two normal distributions with similar variability is considered to be bimodal if their respective means differ by more than the sum of their respective standard deviations.

The term "aspect ratio" as applied herein to particles is understood as being the ratio of the longest dimension of the particle to the shortest dimension. A sphere or a cube has an aspect ratio of 1, for example. An aspect ratio greater than one means the particle is elongated in one direction. Sometimes the aspect ratio is given as less than one, meaning that the longest dimension is used in the denominator rather than the numerator, but is understood in the art to be equivalent to its reciprocal where the aspect ratio is greater than one, e.g., an aspect ratio of 0.5 and 2.0 are equivalent, as are 0.25 and 4.0.

As mentioned above, a gravel filter is installed in a wellbore by gravel packing between a screen and a formation face and/or a casing to reduce and/or prevent formation sand from flowing into the wellbore and to improve wellbore and near-wellbore conductivity. The conductivity at the wellbore and near-wellbore is important because any damage in these locations significantly increases the pressure drop of fluid flow, thereby reducing the producibility or injectivity of the well. Further, placement techniques for gravel filters, with or without simultaneous hydraulic fracturing of the formation, can be a complex procedure. For instance, the placement techniques may require several stages and the proper functioning of moving parts in a hostile wellbore environment.

Accordingly, embodiments of the present disclosure are directed to techniques for transporting and discharging a slurry into a wellbore above a screen to install the gravel filter and depositing the slurry to a viscous pill in contact with a surface of the screen using a bailer device. A stability additive inhibits settling of the slurry (e.g., solids mixture of the slurry), and the viscous pill has a plastic viscosity sufficient to allow the slurry to move in a smooth path or layers and be placed at a desired bottomhole temperature (e.g., slurry treatment fluid).

In certain embodiments, techniques for placing the slurry into the wellbore include preparing the wellbore, deploying a screen in a zone of interest, inserting a viscous pill at the screen, deploying a bailer with a slurry, discharging the slurry under the top of the viscous pill above the screen, and allowing a mixture of the slurry and the viscous pill to settle. The fluid composition of the mixture of the slurry and the viscous pill transforms entrapped proppant between the screen and a section of interest while other components of the mixture are allowed to evacuate the pack. The stabilizing particles are designed to degrade and flow out and limit formation damage and screen plug in.

Some embodiments are unique procedures for creating a high solid fraction fluid. Other embodiments include unique systems, methods, systems, and apparatuses for gravel packing. Further embodiments, forms, objects, features, advantages, aspects, and benefits shall become apparent from the below description and drawings.

In some embodiments, a slurry and method are disclosed for gravel packing. The slurry comprises a solids mixture comprising a plurality of volume-averaged particle size distribution (PSD) modes such that a packed volume fraction (PVF) exceeds 0.75; a carrier fluid in an amount to provide a solids volume fraction (SVF) less than the PVF of the solid's mixture; and stability additives to inhibit settling of the solid's mixture. Stability additives disclosed include colloidal stage, fumed stage, silica particles, solid carbonates, hydratable polymer particles, and particles having an interchangeable aspect ratio as described below.

In some embodiments, the method comprises transporting and discharging the slurry into a wellbore above the screens by using a bailer device, wherein the stability additive inhibits settling of the solids mixture; and thereafter depositing the slurry to a viscous pill in contact with a surface of a screen, wherein the viscosity pill has a plastic viscosity sufficient to allow linear and/or laminal flow placement of the slurry treatment fluid at bottom whole temperatures, or to reduce and/or prevent separation or disturbance of the solids slurry, thereby improving the placement of the gravel filter and its integrity.

With the foregoing in mind, FIG. 1 illustrates a schematic diagram of a system 100 for gravel packing to install a gravel filter. In certain embodiments, the system 100 includes a well 102 drilled through an overburden 104 and a formation of interest 106. The formation of interest 106 may include a hydrocarbon producing formation, a water producing formation, a target formation for injection of a fluid, or other formation of interest known in the art. In certain embodiments, the well 102 has a wellhead 108, and a casing 110 covering at least a portion of the wellbore. In the illustration of FIG. 1, the wellbore through the formation of interest 106 is an "open hole" completion in a vertical well. Other types of completions are contemplated in the present application, including without limitation: a cased completion, multiple zone completions, and/or a horizontal well or well segment. The casing 110 may include a cement layer (not shown) between the casing 110 and the formation (s) (104, 106). Various other features of the system 100 that are known in the art are not shown or described herein to avoid obscuring aspects of the present application.

The system 100 further includes, in certain embodiments, a screen 112 placed in the wellbore. The screen 112 may include slots or holes sized to reduce and/or prevent the flow of particles from the formation of interest 106 into the well 102 or to the surface during treatment flowback or production of the well 102. In certain embodiments, the system 100 includes a gravel filter 114 installed between the screen 112 and the formation of interest 106, such as surfaces of the formation of interest 106 defining the wellbore 102. The gravel of the gravel filter 114 may be installed as a portion of a solids slurry 116 comprising particles (118, 120) and a carrier fluid 122 as described in more detail below.

In certain embodiments, the system 100 includes various devices to control mixing and pumping the solids slurry 116. In one exemplary embodiment, the system 100 includes at least one fluid tank 124 which contains the carrier fluid 122 and/or a base fluid utilized in the creation of the carrier fluid 122. The exemplary embodiment further includes a gravel carrier 126 which, in one embodiment, provides the first amount of particulates 118 to a blending device 128. The blending device 128 prepares the final solids slurry 116, for example mixing the gravel fluid 122 and adding the first amount of particulates 118 from the gravel carrier 126, and further adding any additives, the second amount of particulates 120 and/or third or any other amount of particulates. In certain embodiments, more than one particulate amount may be blended and added by the gravel carrier 126 or other device. The blending device 128 further provides the solids slurry 116 to a pumping device 130 that provides pressurized solids slurry 116 to the wellhead 108. Other equipment configurations are understood in the art and contemplated herein. For example, and without limitation, the system 100 may include a coiled tubing unit (not shown) in place of one or more pieces of equipment and/or tubing 132 connected to the screen 112.

In certain embodiments, the solids slurry 116 is installed in the well 102 via a bailer device to deposit the first amount of particulates 118 and the second amount of particulates 120 between the screen 112 and the formation of interest 106. For example, FIG. 2-1 through FIG. 2-5 illustrate a sequence of acts directed to transporting and discharging the solids slurry 116 into the well 102 above the screen 112 and depositing the solids slurry 116 to a viscous pill 234 in contact with a surface of the screen 112 using a bailer device 236 (also, simply referred to herein as "bailer 236"). A stability additive in the solids slurry 116 inhibits settling of the solids slurry 116 (e.g., solids mixture of the solids slurry 116), and the viscous pill 234 has a plastic viscosity sufficient to allow linear and/or laminar flow placement of the solids slurry 116 (e.g., slurry treatment fluid) at bottomhole temperatures, or placement of the solids slurry 116 at the screen 112 to maintain the solids ratios of the solids slurry 116 and/or prevent suspension of portions of the solids slurry 116 during deposition.

The stability additive may be added to the solids slurry 116 prior to deposition to form the gravel filter. The stability additive may include any component of the solids slurry 116 that may facilitate the particle size distribution (including the packed volume fraction (PVF) exceeding 0.75 and the solids volume fraction (SFV) less than the PVF) being maintained while the solids slurry 116 is deposited to form the gravel filter. The stability additive may include a colloidal stage, a fumed stage, silica particles, alumina (e.g., γ-alumina), magnesium oxide (MgO), iron(III) oxide (e.g., $\gamma$-$Fe_2O_3$), calcium carbonate ($CaCO_3$), bentonite, hydratable polymer particles (e.g., polymer particles having a hydration temperature above about 60° C., such as gellan gum), and particles having an interchangeable aspect ratio, high aspect ratio particles (e.g., particles having an aspect ratio higher than 6). The size of the stability additive may be within a range of from about 50 nm to about 1.0 μm.

The bottomhole temperature experienced during installation of the screen 112, the viscous pill 234, and/or the solids slurry 116 may be based on the temperature of the surrounding formation of interest 106. In some embodiments, the bottomhole temperature may be in a range having an upper value, a lower value, or upper and lower values including any of 50° C., 55° C., 60° C., 65° C., 70° C., 75° C., 80° C., 85° C., 90° C., 95° C., 100° C., 110° C., 120° C., 130° C., 140° C., 150° C., 175° C., 200° C., or any value therebetween. For example, the bottomhole temperature may be greater than 50° C. In another example, the bottomhole temperature may be less than 200° C. In yet other examples, the bottomhole temperature may be any value in a range between 50° C. and 200° C.

As discussed herein, the plastic viscosity of the viscous pill 234 may be sufficient to facilitate formation of the gravel filter while reducing or preventing separation of the particles in the solids slurry 116 and/or suspension of the fine particles of the solids slurry 116 and settling of the larger particles of the solids slurry 116. In other words, the plastic viscosity of the viscosity pill 234 may be selected such that during deposition or placement of the solids slurry 116, the particles (e.g., the fine particles and the larger particles) of the solids slurry 116 flow uniformly between the screen 112 and the wall of the formation of interest 106 and do not exhibit, for example, turbulence in the flow which would disrupt the substantially uniform flow of the solids slurry 116. The plastic viscosity may be calculated by subtracting the 300-rpm shear stress (R300) from the 800-rpm shear stress (R600). In some embodiments, the plastic viscosity of the viscous pill 234 at 80° C. may be in a range having an upper value, a lower value, or upper and lower values, including any of about 10 mPa·s, about 15 mPa·s, about 20 mPa·s, about 25 mPa·s, about 50 mPa·s, about 75 mPa·s, about 100 mPa·s, about 125 mPa·s, about 150 mPa·s, about 175 mPa·s, about 200 mPa·s, or any value therebetween. For example, the plastic viscosity of the viscous pill 234 at 80° C. may be greater than 10 mPa·s. In another example, the plastic viscosity of the viscous pill 234 at 80° C. may be less than 200 mPa·s. In yet other examples, the plastic viscosity of the viscous pill 234 at 80° C. may be any value in a range between 10 mPa·s and 200 mPa·s. In some embodiments, it may be critical that the plastic viscosity of the viscous pill 234 at 80° C. is greater than 100 mPa's to facilitate even deposition of the solids slurry 116 to form the gravel filter.

The high-viscosity fluid of the viscous pill 234 may be formed from a latex dispersion of polyvinylidene chloride, polyvinyl acetate, polystyrene-co-butadiene, hydroxyethylcellulose (HEC), guar, Xanthan, Diutan, biopolymers, copolymers of polyacrylamide and their derivatives, and combinations t thereof. In some embodiments, the viscous pill 234 includes hydroxyethylcellulose.

Figures 1, 2:
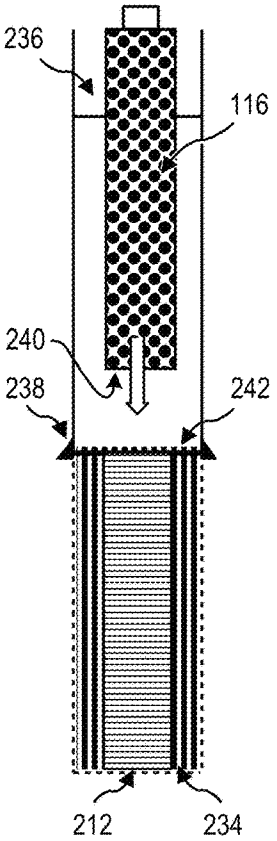
Figure 2:
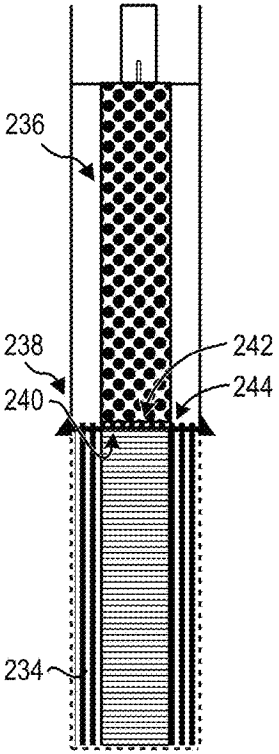

As illustrated in FIG. 2-1, the viscous pill 234 is deposited in a well 102 between a screen 212 and the formation of interest. The viscous pill 234 may be deposited in the well 102 in any manner and at any time. When the viscous pill 234 fully surrounds the screen 112, the deposition of the solids slurry 116 to form the gravel filter may be even or more even, reducing or preventing isolated separation of the particles of the solids slurry 116 based on pockets of low viscosity fluid (e.g., water, oil, drilling fluid, wellbore fluid (e.g., brine), formation fluid (e.g., formation brine)). Disturbance of particles may result in an uneven gravel filter, which may reduce the effectiveness of the gravel filter.

In some embodiments, the screen 112 may be installed at the target location in the wellbore prior to installation of the viscous pill 234. For example, the screen 112 may be placed in the wellbore and secured to the wellbore wall, including with an expandable element, such as a packer 238. The packer 238 may form a collet or other connection point with which the bailer 236 may engage prior to discharging the material (e.g., the high viscosity fluid of the viscous pill 234, the solids slurry 116) within the bailer 236. For example, the packer 238 may include a collet, and the bailer 236 may include a pointed end complementary to the packer 238 such that when the bailer 236 is seated within the collet of the packer 238, the bailer 236 may be placed in a position to discharge its material and flow it into the space below the packer 238.

In some embodiments, the high viscosity fluid may be flowed in the wellbore at the target location when the screen 112 is already in place. For example, the high viscosity fluid may be loaded or pumped into a bailer 236. The bailer 236 may flow the high viscosity fluid out of the bailer 236 and into the wellbore at the screen 112 to form the viscous pill 234. In some embodiments, the high viscosity fluid may be flowed through the center of the screen 112, displacing the existing fluid out of the screen 112 and into the annular space between the screen 112 and the wellbore wall. The high viscosity fluid may then flow through the screen and into the annular space between the screen 112 and the wellbore wall to form the viscous pill 234. In some embodiments, the high viscosity fluid may be flowed into the annular space between the screen 112 and the wellbore wall. The fluid displaced by the high-viscosity fluid may be displaced into the center of the screen 112 and/or up through the annular space. In some embodiments, the high-viscosity fluid may extend into the center of the screen 112. Forming the viscous pill 234 after the screen 112 is fully placed may facilitate placement of the screen 112 at the target location with increased accuracy.

The viscous pill 234 may be deposited in any number of trips of the bailer 236. For example, the volume of the viscous pill 234 (which may be based on the height and diameter of the wellbore) may be greater than or equal to a volume of a storage compartment of the bailer 236. This may result in multiple trips into the wellbore to provide a sufficient volume to place the viscous pill 234.

To install the gravel filter, the solids slurry 116 is pumped into a storage compartment of the bailer 236, as may be seen in the embodiment shown in FIG. 2-1. The bailer 236 used to place the gravel filter may be the same or may be different than the bailer 236 used to place the viscous pill 234. The bailer 236 may be tripped into the wellbore until a discharge end 240 of the bailer 236 engages the collet 242 of the packer 238 (or any other seat and sealing element), as may be seen in FIG. 2-2. When the bailer 236 engages the collet 242 at the packer 238, an upper surface 244 of the viscous pill 234 may be above the discharge end 240 of the bailer 236. In some embodiments, the upper surface 244 of the viscous pill 234 may be above the top of the packer 238. In some embodiments, the discharge end 240 may be inserted into the collet 242 of the packer 238 such that the discharge end 240 is located below the upper surface 244 of the viscous pill 234 while the upper surface 244 of the viscous pill 234 is located below the top of the packer 238. Discharging the bailer 236 when the discharge end 240 is below the upper surface 244 of the viscous pill 234 may reduce or prevent separation of the solids slurry 116 after discharge.

After the bailer 236 is lowered into the well 102 above the screen 112, the solids slurry 116 is allowed to exit the bailer 236 through one or more openings in the bailer 236. For example, the discharge end 240 of the bailer 236 may discharge the contents of the bailer 236 in any manner. For example, the discharge end 240 may include a mechanical valve or door. When the discharge end 240 is seated in the collet 242, the mechanical valve or door may trigger to open, thereby allowing the contents of the bailer 236 to flow out of the bailer 236. In some examples, the discharge end 240 may include a sacrificial part, such as a burst disk, or a shear pin. When the sacrificial part breaks or discharges, the solids slurry 116 in the bailer 236 may be discharged or flow out of the bailer 236. The trigger to discharge the discharge end 240 may be any trigger, including mechanical pressure, fluid pressure, electric signal, any other trigger, and combinations thereof.

Figures 2, 3:
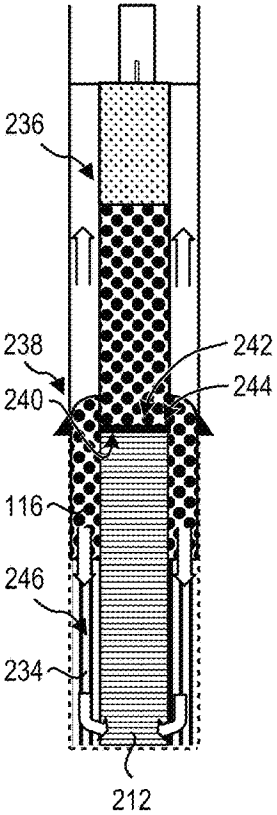

In FIG. 2-3, the bailer 236 is in the process of discharging. For example, the discharge end 240 has opened, and the solids slurry 116 is exiting the bailer 236 and flowing into an annular space 246 between the screen 212 and the wellbore wall. As the solids slurry 116 exits the bailer 236 and is allowed to settle within the well 102, the solids slurry 116 may displace the viscous pill 234 within the well 102. Displacing the viscous pill 234 may cause the viscous pill 234 to rise upwards in the well 102. The composition of the mixture of the solids slurry 116 and the viscous pill 234 transforms entrapped proppant (e.g., fracking sand and other materials) between the screen 112 and the formation of interest 106 while other components of the mixture (e.g., the viscous pill) are allowed to evacuate the pack. The stabilizing particles within the solids slurry 116 are designed to degrade and flow out, thereby limiting damage. In some embodiments, Dissolvable particles may dissolve as an effect of temperature and/or time, other un-dissolvable particles are small end off to be flowed back trough the screen without plugging them.

The viscous pill 234 may be displaced in any manner. For example, the high viscosity fluid of the viscous pill 234 may flow into the screen 212 and into the interior of the screen 212 to flow out of the wellbore. In some examples, the high viscosity fluid of the viscous pill 234 may flow through the solids slurry 116 and out of the annular space 246 between the wellbore wall and the screen 212. In some examples, the high viscosity fluid of the viscous pill 234 may both flow into the screen 212 and through the solids slurry 116 out of the annular space 246.

Figures 2, 3, 4:
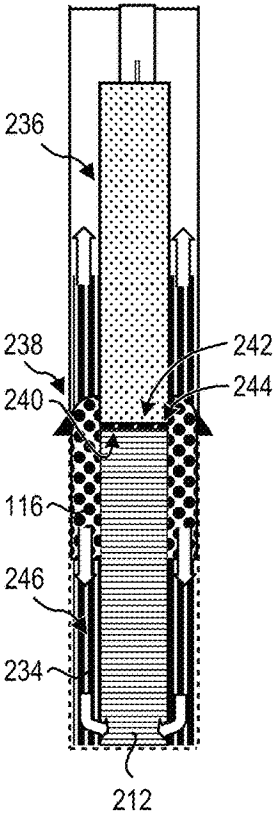

In FIG. 2-4, the solids slurry 116 has been discharged from the discharge end 240 of the bailer 236. The solids slurry 116 may continue to travel into the annular space 246 between the screen 212 and the wellbore wall. As the solids slurry 116 settles into place, the solids slurry 116 may continue to displace the viscous pill 234. As discussed herein, the viscosity of the high viscosity fluid of the viscous pill 234 may reduce turbulence of the solids slurry 116 and facilitate laminal flow as it flows into the annular space 246. For example, the viscosity of the viscous pill 234 may facilitate the particles of the solids slurry 116 flowing at the same velocity or approximately the same velocity. This may reduce or prevent separation of the particles of the solids slurry 116 such that the particle size distribution throughout the solids slurry 116 (e.g., between a location proximate the top of the screen 114 and a location proximate the bottom of the screen 114) remains substantially constant during and after placement of the solids slurry 116. For example, the viscous pill 234 may maintain the solids ratio (e.g., the ratio of solids to liquid in a particular volume) of the solids slurry 116 as the solids slurry 116 flows into the annular space 246. In some embodiments, as the solids slurry 116 is flowed into the annular space 246, the viscous pill 234 may maintains the particle size distribution (PSD) with the packed volume fraction (PVF) exceeding 075 and a solids volume fraction (SVF) less than the PVF of the solids slurry 116.

When the solids slurry 116 has filled the annular space 246 between the screen 212 and the wellbore wall, the solids slurry 116 may settle in the annular space 246 to form a gravel filter 248. In some embodiments, the volume of the carrying space within the bailer 236 may be greater than or equal to the volume of the annular space 246. In this manner, the gravel filter 248 may be deposited in a single trip downhole by the bailer 236. In some embodiments, the volume of the bailer 236 may be less than the volume of the annular space 246. To fill the annular space 246 and completely form the gravel filter 248, the bailer 236 may deliver multiple loads of the solids slurry 116 to the screen 212 at the target area.

With reference to FIG. 2-5, after the solids slurry 116 fills the annular space 246 and displaces the viscosity pill 234, the gravel filter 248 may fill the entire annular space 246 up to the packer 238. In some embodiments, the volume of the gravel filter 248 may be the same as the volume of the viscous pill 234. When the gravel filter 248 is fully installed, the gravel filter 248 may displace the entirety of the viscous pill 234. In some embodiments, the volume of the viscous pill 234 may be greater than the volume of the gravel filter 248. For example, the volume of the viscous pill 234 may include the interior of the screen 212. The remainder of the viscous pill 234 may be flushed out of the interior of the screen 212, such as with a wellbore fluid, water, reservoir fluid, or oil flush.

In some embodiments, after displacement from the annular space 246, the high viscosity fluid 250 from the viscous pill 234 may rise above the packer 238. The high viscosity fluid 250 may be removed from the wellbore after the gravel filter 248 is installed. For example, the high viscosity fluid 250 may be flushed from the wellbore by flushing a drilling or post-completion fluid through the wellbore. In some examples, the high viscosity fluid 250 may be broken up prior to flushing from the wellbore, such as through a tool entering and exiting the space in which the high viscosity fluid 250 is located.

In accordance with at least one embodiment of the present disclosure, a gravel filter installation system may be installed in an existing downhole system. For example, FIG. 3-1 through FIG. 3-5 illustrate a series of schematic partial cut-away diagrams of a gravel filter installation system 300 using a bailer 336 to install a gravel filter, including using the bailer 336 to deposit a slurry of particulates between an outer surface of a screen 312 and a surface of a wellbore formation for an existing completion. First, in FIG. 3-1 a run in hole (RIH) straddle packer 338 is deployed to a target location at a desired depth within an annulus within a well 102 to isolate an unwanted zone of the annulus. A RIH perforation gun may perforate a desired section of the annulus with a plurality of perforations 354 at the target location.

In FIG. 3-2, the RIH has installed a screen 312 at the straddle packer 338 proximate the perforations 354. The screen 312 may be any type of screen. For example, the screen 312 may include an outer mesh layer having a mesh size that may prevent and/or reduce ingress of sand, proppant, and particles from the gravel filter or slurry. The outer mesh layer may surround an inner pipe that includes one or more holes therethrough. Fluid from the wellbore, including post-completion fluid, may flow into the screen 312.

In FIG. 3-3, a bailer 336 is inserted into the wellbore to place a viscous pill 334 at the screen 312. Optionally, fluid within the wellbore is displaced with the viscous pill 334. The viscous pill 334 may be deployed via the RIH with bailer in the annulus outside of the screen to the top of the bailer opening. As discussed herein, the viscous pill 334 may be installed in any manner, such as through one or more trips with the viscous pill 334.

In FIG. 3-4, a bailer 336 includes a slurry 316 in a storage chamber. The slurry 316 may include a mixture of particulates that may be deposited at the screen 312 to form a gravel filter. The slurry 316 may be deployed via the RIH with the bailer 336 within the annulus outside of the screen. The slurry 316 may displace the viscous pill 334 such that the viscous pill 334 may flow out of the straddle packer 338. As discussed herein, the viscous pill 334 may facilitate even placement of the slurry 316 to form a gravel filter 348. The viscosity of the viscous pill 334 may reduce or prevent separation of the particles of the slurry 316, thereby improving the quality of the gravel filter 348.

In some embodiments, the same bailer 336 deposits the viscous pill 334 and the gravel filter 348. In some embodiments, different bailers 336 deposit the viscous pill 334 and the gravel filter 348. For example, different bailers 336 may be used based on the different properties of the high-viscosity fluid and the slurry.

Figures 2, 3, 4, 5:
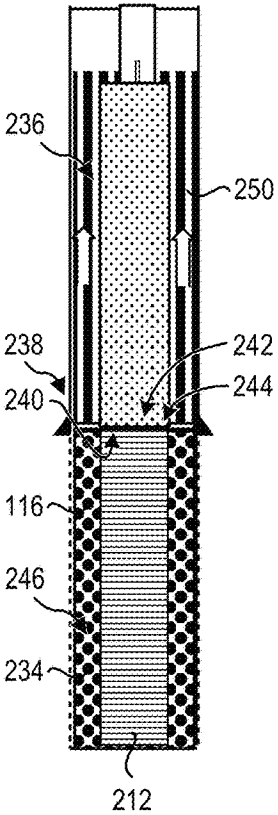
Figures 3, 4, 5:
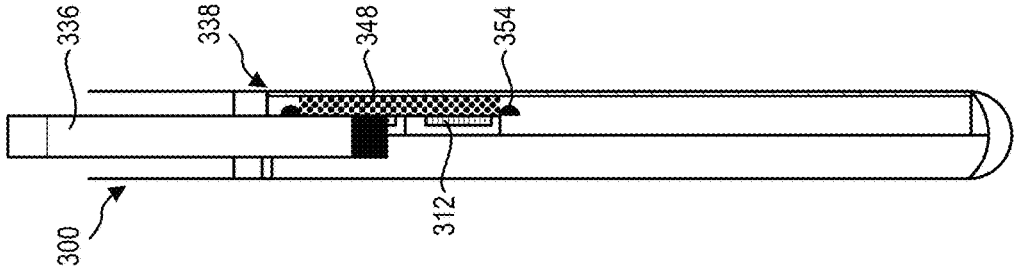
Figures 3, 4:
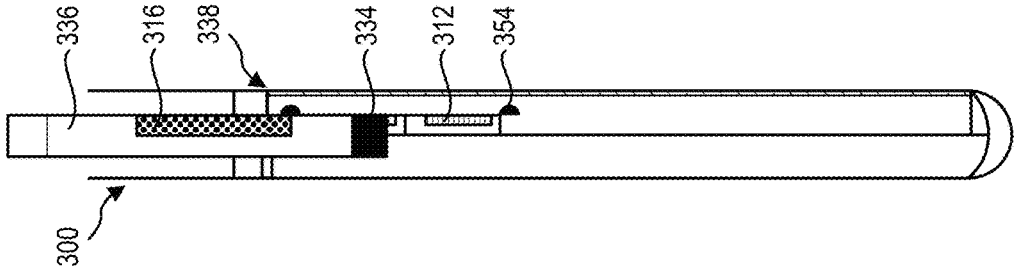
Figure 3:
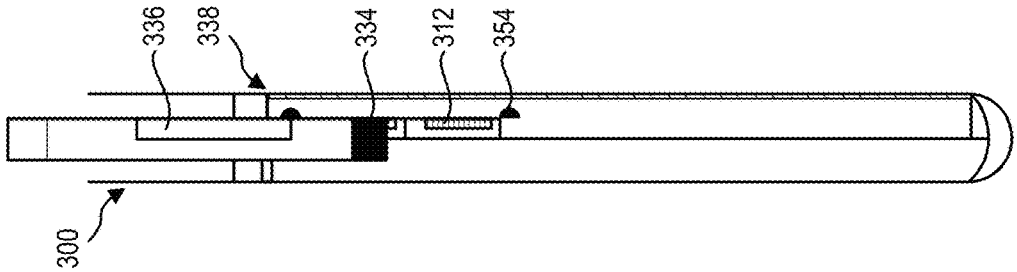
Figures 2, 3:
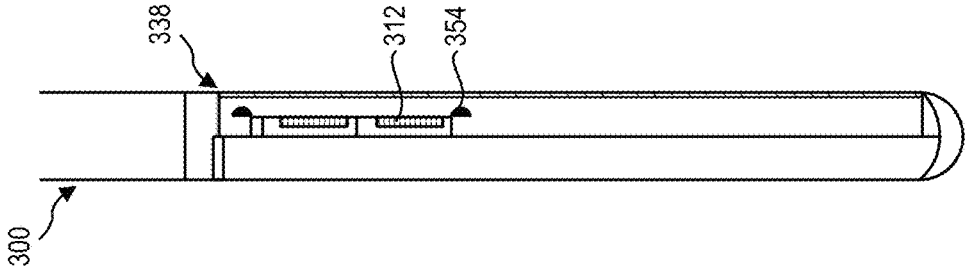
Figures 1, 3:
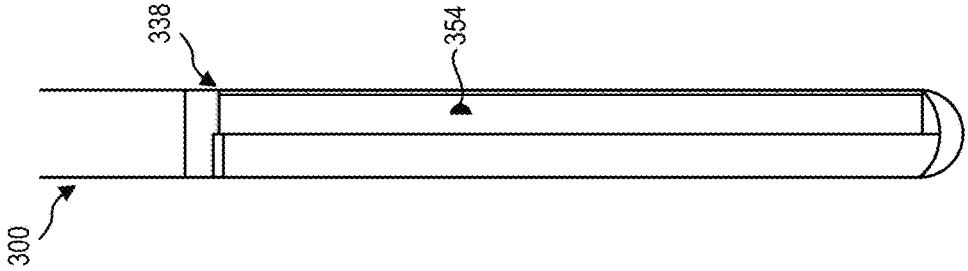
Figure 4:
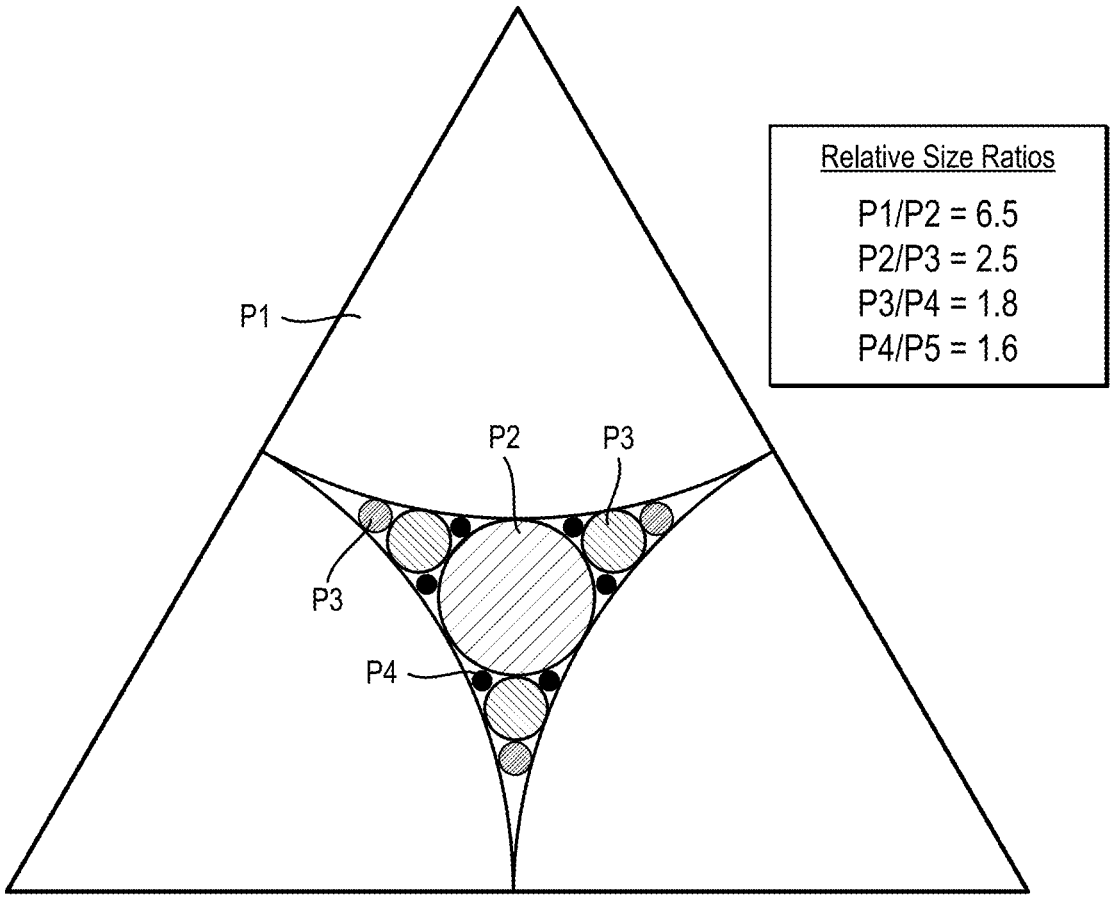
Figure 5:
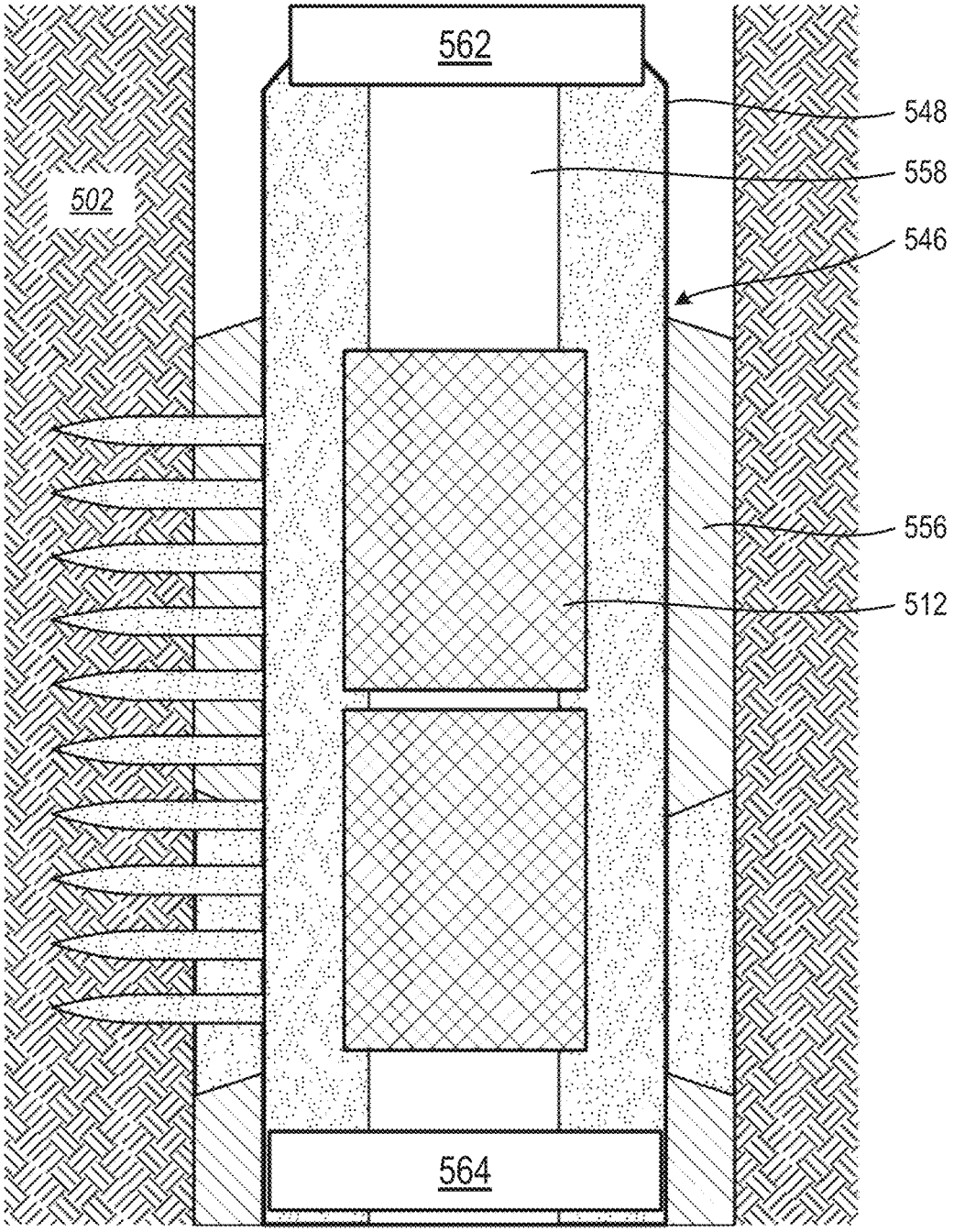

In FIG. 3-5, the gravel filter 348 has been placed in the straddle packer 338, and the viscous pill has been displaced by the gravel filter 348. The bailer 336 may be removed and the remaining high viscosity fluid may be flushed out of the wellbore. After the last run of the bailer with the slurry, a communication port below the top straddle backer may be closed.

An approximate packing model for the particle size ratios according to one embodiment is seen in FIG. 4, which was obtained using the Descartes circle theorem. For four mutually tangent circles with curvatures, $P_n$, $P_{n+1}$, $P_{n+2}$, and $P_{n+3}$, the following equation (1) is applicable:

$$\frac{1}{P_2}+\frac{1}{P_{n+1}^2}+\frac{1}{P_{n+2}^2}+\frac{1}{P_{n+3}^2}=\frac{1}{2}\left(\frac{1}{P_n}+\frac{1}{P_{n+1}}+\frac{1}{P_{n+2}}+\frac{1}{P_{n+3}}\right)^2 \quad (1)$$

where $P_n$ is the curvature of circle n, where curvature is taken as the reciprocal of the radius. For example, when three equally sized spheres (Size P1=1) are touching each other, the size (diameter) ratio of P1/P2 can be obtained using the above equation to be 6.464~6.5. Similarly, the other ratios for the particle sizes required to stop leak-off in an embodiment can be estimated as P2/P3 being about 2.5 and P3/P4 being about 1.8, and when a fifth particle is used, P4/P5 is about 1.6. As a practical matter it can be difficult to obtain and/or work with particles having an average size range less than about 10 μm at the accuracy required, and one embodiment compensates by using a relatively large proportion of the fourth particle wherein the fourth particle has an average size between 10 and 20 μm.

FIG. 5 is a representation of a gravel filter 548 installed in a well 502, according to at least one embodiment of the present disclosure. The gravel filter 548 is installed in an annular space 546 between a screen 512 and a casing 556 or the wellbore wall of the well 502. The gravel filter 512 may surround a central pipe 558 and prevent ingress of particles from the gravel filter 548 into the central pipe 558. The gravel filter 512 may be installed between a top straddle packer 562 and a bottom straddle packer 564.

As discussed in further detail herein, the gravel filter 548 may be installed when a bailer releases the solids slurry at the central pipe 558. The annular space 546 may be filled with a viscous pill. When the solids slurry is released or flowed into the annular space 546, the solids slurry may displace the viscous pill. The viscous pill may be displaced through the gravel filter 512 and/or through the solids slurry and out of the top straddle packer 562. The bottom straddle packer 564 may seal the bottom of the gravel filter 548 to prevent the solids from flowing further downhole.

Figures 2, 6:
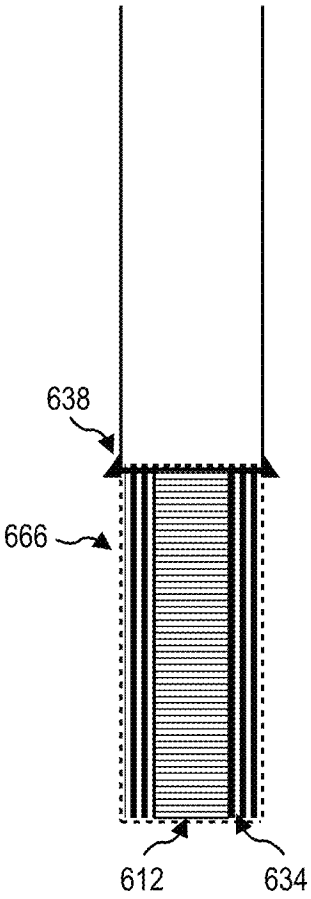
Figures 1, 6:
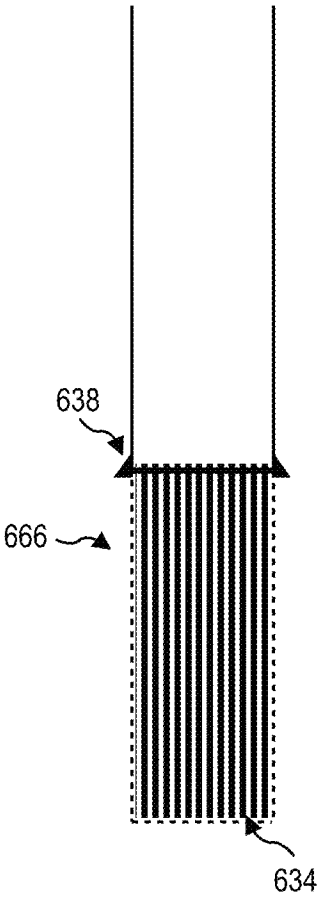

FIG. 6-1 and FIG. 6-2 are representations of a sequence of acts for the installation of a screen 612 in a wellbore, according to at least one embodiment of the present disclosure. In FIG. 6-1, a viscous pill 634 has been installed at a target location 666. The target location 666 may be located at a packer 638. The viscous pill 634 may be installed prior to the installation of a screen at the target location 666. For example, after the installation of the viscous pill 634, an operator may install a screen 612 at the target location 666, as illustrated in FIG. 6-2.

Figures 2, 7:
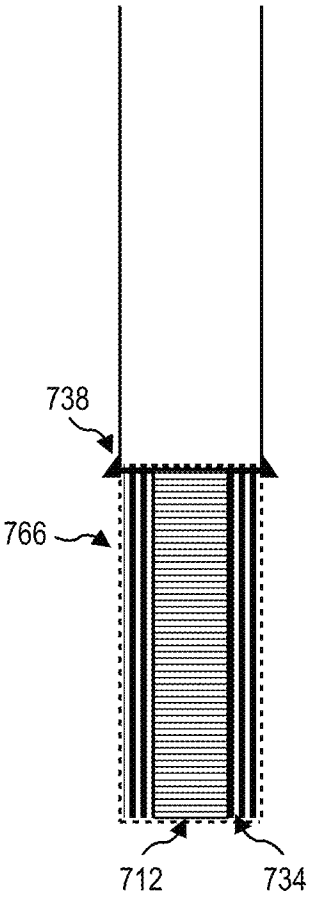
Figures 1, 7:
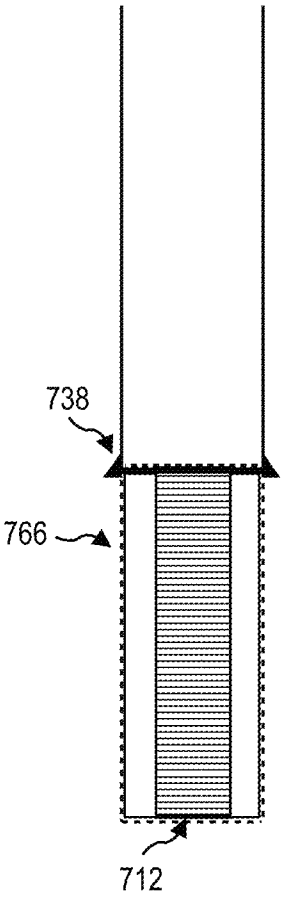

FIG. 7-1 and FIG. 7-2 are representations of a sequence of acts for the installation of a screen 712 in a wellbore, according to at least one embodiment of the present disclosure. In FIG. 6-1, the screen 712 has been installed at a target location 766. The target location 766 may be located at a packer 738. The viscous pill 734 may be installed after to the installation of the screen 712 at the target location 766. For example, after the installation of the screen 712, an operator may install a viscous pill 734 at the target location 766, as illustrated in FIG. 7-2.

Figure 8:
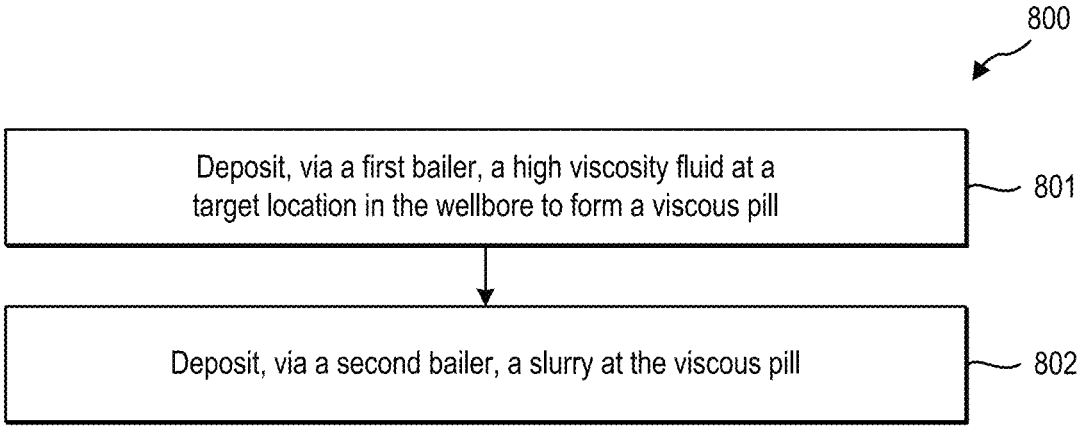
FIG. 8 is a flowchart of a method for installing a gravel filter in a wellbore in accordance with embodiments of the present disclosure.

FIG. 8 is a flowchart of a method 800 for installing a gravel filter in a wellbore, according to at least one embodiment of the present disclosure. The method 800 includes depositing, via a first bailer, a high viscosity fluid at a target location in the wellbore at 801. Depositing the high viscosity fluid may form a viscosity pill at the target location. As discussed herein, the target location may be a screen or other downhole structure at which a gravel filter may be installed. The high viscosity fluid may have a plastic viscosity that is greater than a working fluid viscosity of a working fluid in the wellbore. For example, the plastic viscosity of the high viscosity fluid may be greater than the working fluid viscosity of the working fluid such that the high viscosity fluid and the working fluid do not mix. In some embodiments, the working fluid viscosity of the working fluid may be the viscosity of water, oil, brine, or other working fluid or completion fluid. In some embodiments, as discussed herein, the target location includes a screen, and the high viscosity fluid forms the viscous pill at the screen.

The method 800 may include depositing, via a second bailer, a solids slurry at the viscous pill at 802. For example, the second bailer may deposit the solids slurry at the target location. The solids slurry may displace the viscous pill from the target location. In some embodiments, the viscous pill is at least partially displaced through the screen. In some embodiments, the first bailer and the second bailer are the same bailer. In some embodiments, the first bailer and the second bailer are different bailers.

As discussed herein, depositing the solids slurry at the viscous pill may maintain a particle size distribution of the solids slurry. In some embodiments, maintaining the particle size distribution may include maintaining a packed volume fraction that exceeds 0.75 and a solids volume fraction less than the packed volume fraction.

In some embodiments, as discussed herein, depositing the high viscosity fluid includes engaging a collet at the target location with the bailer and depositing the high viscosity fluid until an upper surface of the viscous pill rises above the collet. In some embodiments, the slurry is deposited below the upper surface of the viscous pill.

Figure 9:
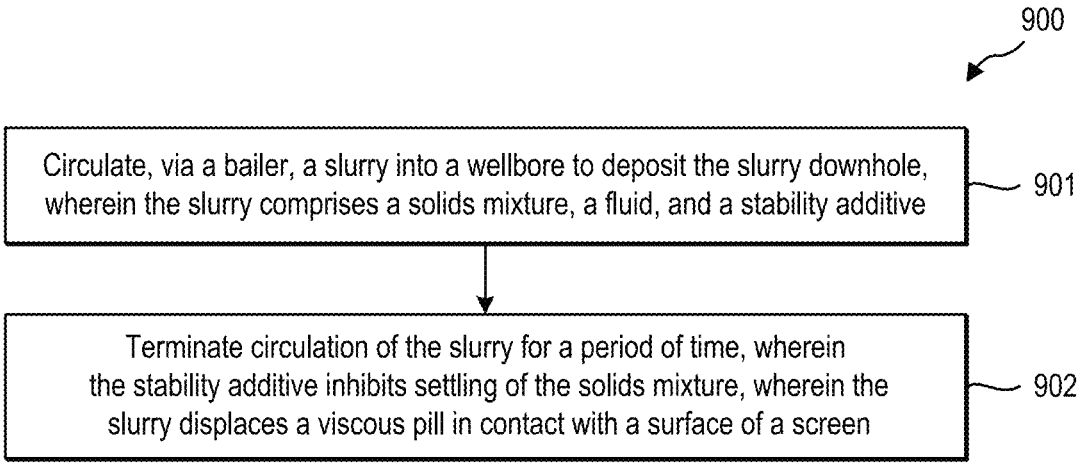
FIG. 9 is a flowchart of a method for installing a gravel filter in a wellbore in accordance with embodiments of the present disclosure.

FIG. 9 is a flowchart of a method 900 for installing a gravel filter in a wellbore, according to at least one embodiment of the present disclosure. An operator may place, via a bailer, a slurry into a wellbore to deposit the slurry downhole at 901. The slurry may include a solids mixture, a fluid, and a stability additive. The slurry may be placed in any manner. For example, the operator may place the slurry by flowing the slurry into the bailer, and the bailer may deposit the slurry at a target location. In some embodiments, placing may include filling and emptying any number of loads in the bailer.

In some embodiments, the operator may terminate placement of the slurry for a period of time at 902. The stability additive may inhibit settling or separation of the solids mixture. The slurry may displace a viscous pill in contact with a surface of a screen. In some embodiments, the operator may terminate placement of the slurry for the period of time between returning the bailer to the surface, re-filling the bailer, and tripping the bailer back to the target location. In some embodiments, the operator may terminate placement of the slurry for a period of time longer than the return cycle of the bailer. For example, the operator may terminate placement of the slurry for a period of time based on the deposition rate of the slurry in the viscous pill.

In some embodiments, the viscous pill has a plastic viscosity sufficient to allow linear and/or laminar flow placement of the slurry at bottomhole temperatures. In some embodiments, the viscous pill prohibits suspension of the slurry, or prohibits suspension of fine particulate matter in the viscous pill.

In accordance with certain embodiments of the disclosure, a method for depositing a solids slurry in a wellbore includes depositing, via a first bailer, a high viscosity fluid at a target location in the wellbore to form a viscous pill and depositing, via a second bailer, a slurry at the viscous pill. The high viscosity fluid has a plastic viscosity that is greater than a working fluid viscosity of a working fluid in the wellbore. Additionally, depositing the slurry at the viscous pill displaces the viscous pill from the target location.

In some embodiments, depositing the slurry at the viscous pill maintains a particle size distribution of the slurry while depositing the slurry. In some embodiments, depositing the slurry at the viscous pill maintains a packed volume fraction (PVF) that exceeds 0.75 and a solids volume fraction (SVF) less than the PVF. In some embodiments, depositing the high viscosity fluid includes engaging a collet at the target location with the bailer and depositing the high viscosity fluid until an upper surface of the viscous pill rises above the collet. In some embodiments, depositing the slurry at the viscous pill includes engaging the collet with the bailer and depositing the slurry below the upper surface of the viscous pill.

In some embodiments, the target location includes a screen, and depositing the high viscosity fluid forms the viscous pill between the screen and a wellbore wall of the wellbore. In some embodiments, depositing the slurry at the viscous pill includes depositing the slurry between the screen and the wellbore wall such that at least a portion of the viscous pill is displaced through the screen. In some embodiments, depositing the high viscosity fluid includes depositing the high viscosity fluid over a plurality of trips of the first bailer into the wellbore. In some embodiments, depositing the slurry includes depositing the slurry over a plurality of trips of the second bailer into the wellbore.

In accordance with certain embodiments of the present disclosure, a gravel filter installation system includes a screen, a viscous pill deposited at the screen, a solids slurry having a particle size distribution (PSD) such that a packed volume fraction (PVF) exceeds 0.75, and a bailer configured to deposit the solids slurry at the viscous pill such that the solids slurry displaces the viscous pill. The viscous pill has a plastic viscosity greater than about 100 mPa·s at 100° C. Additionally, the solids slurry includes a solids volume fraction (SVF) less than the PVF of the solids slurry.

In some embodiments, the gravel filter installation system also includes a screen and a packer above the screen. The bailer includes a discharge end complementary to a collet at the packer. In some embodiments, an upper surface of the viscous pill, prior to deposition of the solids slurry, extends above the screen. In some embodiments, the screen has a mesh size sufficient to prevent flowing of the solids slurry therethrough.

In accordance with certain embodiments of the present disclosure, a method includes placing, via a bailer, a slurry into a wellbore to deposit the slurry downhole and terminating placement of the slurry for a period of time. The slurry includes a solids mixture and a fluid. A viscous pill at the wellbore inhibits settling of the solids mixture, and the slurry displaces the viscous pill in contact with a surface of a screen.

In some embodiments, the viscous pill has a plastic viscosity sufficient to allow linear flow placement of the slurry at bottomhole temperatures. In some embodiments, the solids mixture has a particle size distribution (PSD) such that a packed volume fraction (PVF) exceeds 0.75, wherein the slurry comprises a solids volume fraction (SVF) less than the PVF of the solids mixture. In some embodiments, placing the slurry into the wellbore maintains the SVF and PVF at the screen. In some embodiments, the viscous pill prohibits suspension of the slurry. In some embodiments, the slurry displaces the viscous pill through the screen. In some embodiments, placing the slurry into the wellbore includes depositing the slurry below an upper surface of the viscous pill.

The specific embodiments described above have been illustrated by way of example, and it should be understood that these embodiments may be susceptible to various modifications and alternative forms. It should be further understood that the claims are not intended to be limited to the particular forms disclosed, but rather to cover all modifications, equivalents, and alternatives falling within the spirit and scope of this disclosure.

The techniques presented and claimed herein are referenced and applied to material objects and concrete examples of a practical nature that demonstrably improve the present technical field and, as such, are not abstract, intangible, or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112 (f). However, for any claims containing elements designated in any other manner, it is intended that such elements are not to be interpreted under 35 U.S.C. 112 (f).

The invention claimed is:

1. A method for depositing a solids slurry in a wellbore, the method comprising:

depositing, via a first bailer, a high viscosity fluid at a target location in the wellbore to form a viscous pill, the high viscosity fluid having a plastic viscosity that is greater than a working fluid viscosity of a working fluid in the wellbore; and depositing, via a second bailer, a slurry at the viscous pill, wherein depositing the slurry at the viscous pill displaces the viscous pill from the target location.

2. The method of claim 1, wherein depositing the slurry at the viscous pill maintains a particle size distribution of the slurry while depositing the slurry.

3. The method of claim 2, wherein depositing the slurry at the viscous pill maintains a packed volume fraction (PVF) that exceeds 0.75 and a solids volume fraction (SVF) less than the PVF.

4. The method of claim 1, wherein depositing the high viscosity fluid includes engaging a collet at the target location with the first bailer and depositing the high viscosity fluid until an upper surface of the viscous pill rises above the collet.

5. The method of claim 4, wherein depositing the slurry at the viscous pill includes engaging the collet with the second bailer and depositing the slurry below the upper surface of the viscous pill.

6. The method of claim 1, wherein the target location includes a screen, and depositing the high viscosity fluid forms the viscous pill between the screen and a wellbore wall of the wellbore.

7. The method of claim 6, wherein depositing the slurry at the viscous pill includes depositing the slurry between the screen and the wellbore wall such that at least a portion of the viscous pill is displaced through the screen.

8. The method of claim 1, wherein depositing the high viscosity fluid includes depositing the high viscosity fluid over a plurality of trips of the first bailer into the wellbore.

9. The method of claim 1, wherein depositing the slurry includes depositing the slurry over a plurality of trips of the second bailer into the wellbore.

10. A gravel filter installation system, comprising:

a screen;

a viscous pill deposited at the screen, the viscous pill having a plastic viscosity greater than about 100 mPa·s at 100° C.;

a solids slurry having a particle size distribution (PSD) such that a packed volume fraction (PVF) exceeds 0.75, wherein the solids slurry comprises a solids volume fraction (SVF) less than the PVF of the solids slurry; and a bailer configured to deposit the solids slurry at the viscous pill such that the solids slurry displaces the viscous pill.

11. The gravel filter installation system of claim 10, further comprising a screen and a packer above the screen, the bailer including a discharge end complementary to a collet at the packer.

12. The gravel filter installation system of claim 11, wherein an upper surface of the viscous pill, prior to deposition of the solids slurry, extends above the screen.

13. The gravel filter installation system of claim 10, wherein the screen has a mesh size sufficient to prevent flowing of the solids slurry therethrough.

14. A method, comprising:

placing, via a bailer, a slurry into a wellbore to deposit the slurry downhole, wherein the slurry comprises a solids mixture and a fluid; and terminating placement of the slurry for a period of time, wherein a viscous pill at the wellbore inhibits settling of the solids mixture, wherein the slurry displaces the viscous pill in contact with a surface of a screen.

15. The method of claim 14, wherein the viscous pill has a plastic viscosity sufficient to allow linear flow placement of the slurry at bottomhole temperatures.

16. The method of claim 14, wherein the solids mixture has a particle size distribution (PSD) such that a packed volume fraction (PVF) exceeds 0.75, wherein the slurry comprises a solids volume fraction (SVF) less than the PVF of the solids mixture.

17. The method of claim 16, wherein placing the slurry into the wellbore maintains the SVF and the PVF at the screen.

18. The method of claim 14, wherein the viscous pill prohibits suspension of the slurry.

19. The method of claim 14, wherein the slurry displaces the viscous pill through the screen.

20. The method of claim 14, wherein the placing the slurry into the wellbore includes depositing the slurry below an upper surface of the viscous pill.

* * * * *